US008092122B2

(12) United States Patent
Senf et al.

(10) Patent No.: US 8,092,122 B2
(45) Date of Patent: Jan. 10, 2012

(54) CONNECTION DEVICE FOR FASTENING EXPANDED CELL CONFINEMENT STRUCTURES AND METHODS FOR DOING THE SAME

(75) Inventors: Daniel F. Senf, Grand Chute, WI (US); Kai Tietjen, Thedinghausen (DE); Cory Schneider, Green Bay, WI (US); William Handlos, Manitowoc, WI (US); Gary M. Bach, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 525 days.

(21) Appl. No.: 12/268,084

(22) Filed: Nov. 10, 2008

(65) Prior Publication Data

US 2010/0119766 A1 May 13, 2010

(51) Int. Cl.
*E02D 3/00* (2006.01)

(52) U.S. Cl. ..... 405/302.4; 405/302.6; 403/408.1; 24/458

(58) Field of Classification Search ..... 405/258.1, 405/302.4, 302.6, 302.7; 403/408.1; 24/200, 24/458

See application file for complete search history.

(56) References Cited

U.S. PATENT DOCUMENTS

| | | | | | |
|---|---|---|---|---|---|
| 1,666,783 | A | * | 4/1928 | Kries | 411/337 |
| 1,900,574 | A | * | 3/1933 | Meader | 403/408.1 |
| 2,041,335 | A | * | 5/1936 | Hall | 403/408.1 |
| 3,568,263 | A | * | 3/1971 | Meehan | 24/458 |
| 3,990,131 | A | * | 11/1976 | Okamura | 403/408.1 |
| 4,530,622 | A | | 7/1985 | Mercer | |
| 4,647,325 | A | | 3/1987 | Bach | |
| 4,681,288 | A | * | 7/1987 | Nakamura | 24/453 |
| 4,717,283 | A | | 1/1988 | Bach | |
| 4,778,309 | A | | 10/1988 | Bach et al. | |
| 4,804,293 | A | | 2/1989 | Várkonyi et al. | |
| 4,965,097 | A | | 10/1990 | Bach | |
| 5,143,467 | A | * | 9/1992 | Gardner | 403/408.1 |
| 5,333,965 | A | * | 8/1994 | Mailey | 403/408.1 |
| 5,449,543 | A | | 9/1995 | Bach et al. | |
| 5,758,987 | A | * | 6/1998 | Frame et al. | 403/408.1 |
| 5,927,906 | A | * | 7/1999 | Bach et al. | 405/302.6 |
| 6,395,372 | B1 | | 5/2002 | Bach | |

(Continued)

FOREIGN PATENT DOCUMENTS

CH 696 851 A5 12/2007

(Continued)

OTHER PUBLICATIONS

Wells, James C., Results of Direct Shearbox Tests on Performated Geoweb® Reinforcement with Coarse Sand, Feb. 1993.

(Continued)

*Primary Examiner* — Frederick L Lagman
(74) *Attorney, Agent, or Firm* — Merchant & Gould P.C.

(57) ABSTRACT

A connection device for fastening two expanded cellular confinement structures includes an insertion member having insertion ends, an insertion member extension, an integral shank, and a handle member. A cellular confinement system includes first and second webs of cells made from strips bonded together in spaced apart areas. The strips form walls of the cells and at least some of the cells define open slots. At least one connection device fastens the first web and the second web together through the open slots. A method of fastening two expanded cellular confinement structures includes aligning two expanded cellular confinement structures; inserting an insertion member of a connection device through open slots; and turning the connection device.

25 Claims, 13 Drawing Sheets

U.S. PATENT DOCUMENTS

| | | | | |
|---|---|---|---|---|
| 6,554,545 | B1 * | 4/2003 | Hall | 405/302.4 |
| 6,745,662 | B2 | 6/2004 | Ford | |
| 7,179,013 | B2 * | 2/2007 | Benedetti | 403/408.1 |
| 2008/0213521 | A1 | 9/2008 | Halahmi et al. | |
| 2009/0151136 | A1 * | 6/2009 | Ramsauer | 24/458 |
| 2009/0199372 | A1 * | 8/2009 | Anderson | 24/458 |

FOREIGN PATENT DOCUMENTS

| | | |
|---|---|---|
| JP | 56-16730 | 2/1981 |
| JP | 57-3923 | 1/1982 |
| JP | 58-101932 | 6/1983 |
| JP | 58-106020 | 6/1983 |
| JP | 58-131228 | 8/1983 |
| JP | 61-10630 | 1/1986 |
| JP | 63-151712 | 6/1988 |

OTHER PUBLICATIONS

Wells, James C., Results of Large-Scale Shearbox Tests of Performated Geoweb® Reinforcement with Crushed Limestone, Mar. 1993.

Invitation to Pay Additional Fees with Partial International Search mailed Apr. 7, 2010.

International Search Report and Written Opinion mailed Jun. 10, 2010.

* cited by examiner

CONNECTION DEVICE FOR FASTENING EXPANDED CELL CONFINEMENT STRUCTURES AND METHODS FOR DOING THE SAME

TECHNICAL FIELD

This disclosure relates to connection devices for expanded cellular confinement structures for the confinement of infill material. In particular, this disclosure relates to connectors and methods used for fastening together at least two expanded cellular confinement structures.

BACKGROUND

A cellular confinement structure serves to increase the load bearing capacity, stability, and erosion resistance of infill materials which are placed within the cells of the system. A commercially available system is Geoweb® plastic web confinement structure sold by Presto Products, Inc., Appleton, Wis. Geoweb® cells are made from high density polyethylene strips that are joined by welds on their faces in a side-by-side relationship at alternating spaces so that when the strips are stretched out in a direction perpendicular to the faces of the strips, the resulting web section is honeycomb-like in appearance, with sinusoidal or undulated-shaped cells. Geoweb® sections are lightweight and are shipped in their collapsed form for ease in handling and installation. Geoweb® systems have been described in U.S. Pat. Nos. 6,395,372; 4,778,309; 4,965,097; and 5,449,543, each of these patents being incorporated by reference herein.

The cellular confinement structures are typically arranged adjacent to each other and then connected together. In the past, these sections have been connected together by using staples, wires, cable ties, etc. These devices are labor-intensive and consume excessive construction time. In many implementations, these types of connections are difficult to use because of the particular situation or terrain. Most often, these types of connection systems require power from generators and air actuation from compressors. The requirement for power can add to the difficulty, given the particular environment or terrain that such cellular confinement systems are typically placed. The unit cost per connection can be quite high on smaller projects as the fixed costs for supply of generators and air compressors are similar to a small installation as would be required for a large installation. Moreover, some of these connection devices provide relatively weak structural connections and are non-durable. In some implementations, these are not problems. In many applications, however, speed is important and the availability of power equipment is challenging. In many implementations, long-term durability is mandatory. Improvements are desirable.

SUMMARY OF THE DISCLOSURE

A connection device for fastening two expanded cellular confinement structures is provided. In general, the connection device includes an insertion member having first and second opposite insertion ends and an insertion member extension therebetween. An integral shank extends from the insertion member extension and is spaced from each of the first and second insertion ends. A handle member extends generally from the shank at an end of the shank that is remote from the insertion member. The handle member has first and second handle ends and a handle member extension therebetween. The shank is spaced from each of the first and second handle ends.

In another aspect, a cellular confinement system is provided. The cellular confinement system includes first and second unitary webs of cells made from elongated plastic strips bonded together in spaced apart areas. The strips form walls of the cells and at least some of the cells define open slots. At least one open slot of a first unitary web of cells is aligned with at least one open slot of a second unitary web of cells to result in a cell overlap region. The cell overlap region has opposite first and second sides. At least one connection device fastens the first unitary web of cells and the second unitary web of cells together. The connection device can be the type as characterized above. When used, the insertion member is located on the first side of the cell overlap region. The shank extends through the cell overlap region by extending through both of the aligned slots of the first and second unitary web of cells. The handle member is located on the second side of the cell overlap region.

In another aspect, a method of fastening two expanded cellular confinement structures together is provided. The method includes aligning two expanded cellular confinement structures so that at least one open slot defined by a first unitary web of cells is aligned with at least one open slot defined by a second unitary web of cells to form an overlap region having first and second sides. The method includes inserting an insertion member of a connection device from the second side of the overlap region through the aligned open slots of the overlap region to provide: the insertion member on the first side of the overlap region; a handle member of the connection device on the second side of the overlap region; and a shank member between the insert member and the handle member extending through the overlap region.

In some implementations, the method further includes rotating the handle to rotate the connection device within the overlap region.

DETAILED DESCRIPTION

Figure 1:
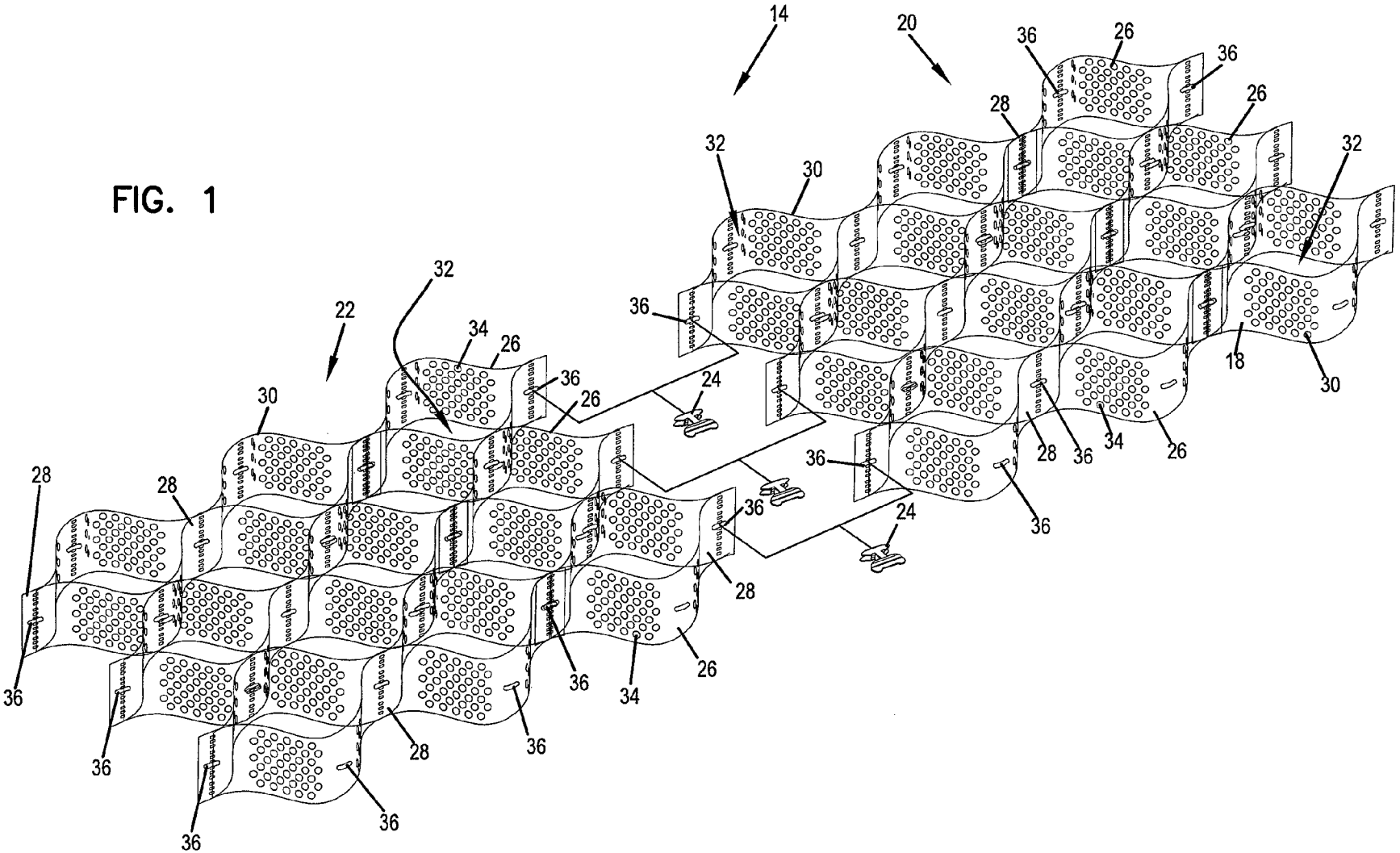
FIG. 1 is a schematic, exploded perspective view of a cellular confinement system and connection devices, prior to assembly end-to end, utilizing principles in accordance with this disclosure.
Figure 1A:
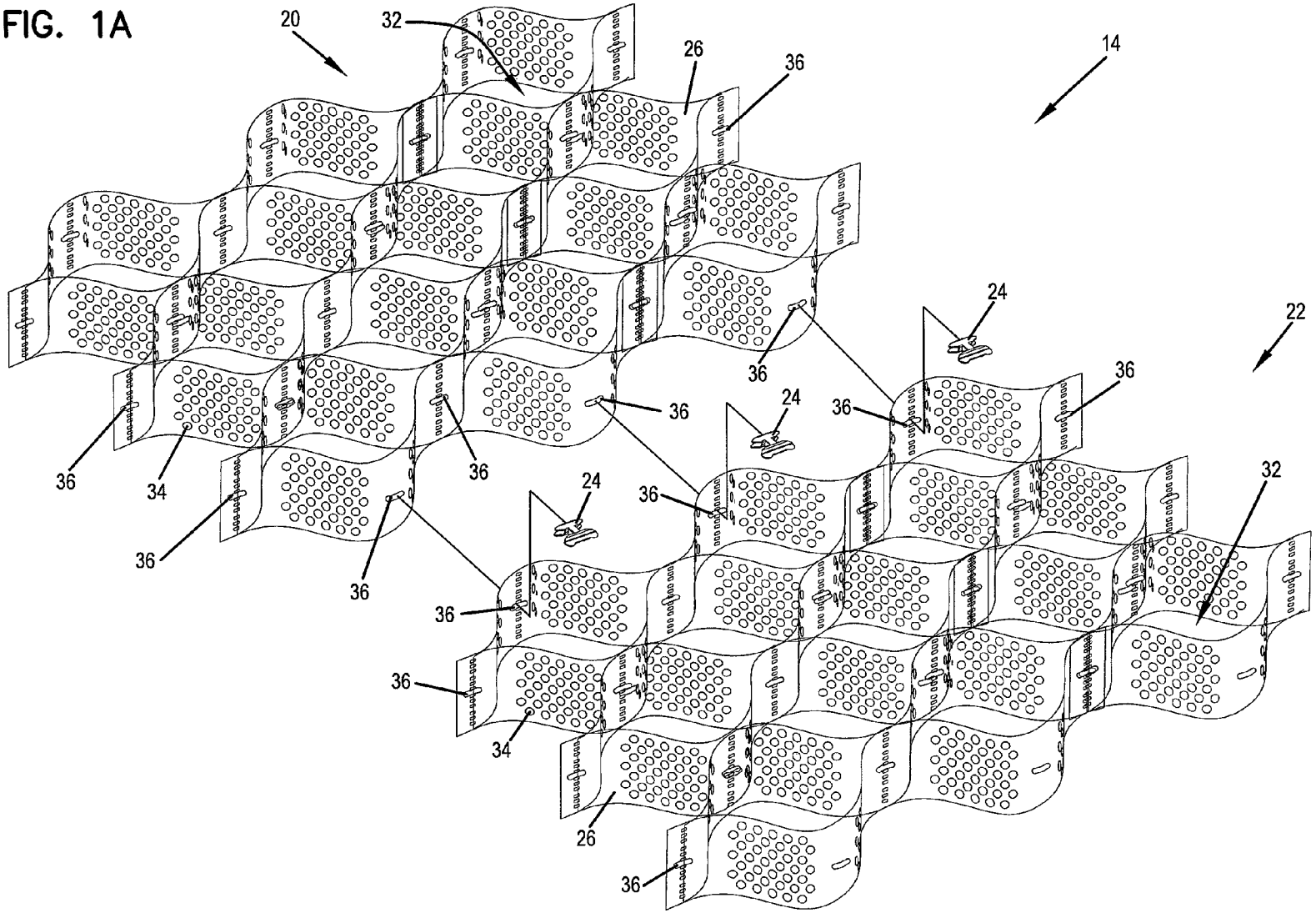
FIG. 1A is a schematic, exploded perspective view of a cellular confinement system and connection devices, prior to lateral assembly, utilizing principles in accordance with this disclosure.

In FIGS. 1 and 1A, there is depicted a cellular confinement system 14. In the particular implementation shown, the cellular confinement system 14 includes first and second unitary webs of cells 18. The first web of cells is shown at 20, while the second web of cells is shown at 22. In the embodiment shown, the cellular confinement system 14 further includes at least one connection device 24 for fastening together the first web 20 and second web 22.

FIG. 1 shows the system 14 before the first and second webs 20, 22 are connected together in an end-to-end manner. FIG. 1A shows the system 14 before the first and second webs 20, 22 are connected together side-by-side (laterally). Each of the expanded cellular confinement structures 18 has a plurality of strips of plastic 26 that are bonded together, one strip to the next at alternating and equally spaced bonding areas 28 to form cell walls 30 of individual cells 32. When the plurality of strips 26 are stretched in a direction perpendicular to the face of the strips, the strips 26 bend in a sinusoidal manner and form webs 20, 22 of cells 32 in a repeating cell pattern. Each cell 32 has a cell wall 30 that is made up from one strip 26 and a cell wall 30 made from a different strip 26.

In this embodiment, the strips 26 define apertures 34. The apertures 34 can be used to accommodate tendons to reinforce the webs 20, 22 and improve the stability of web installations by acting as continuous, integral anchoring members to prevent unwanted displacement of the webs 20, 22. The apertures 34 also help to allow for aggregate interlock while maintaining sufficient wall stiffness for construction site infilling. Optimized aperture sizes and patterns are described in U.S. Pat. No. 6,395,372, incorporated by reference herein.

Figure 2:
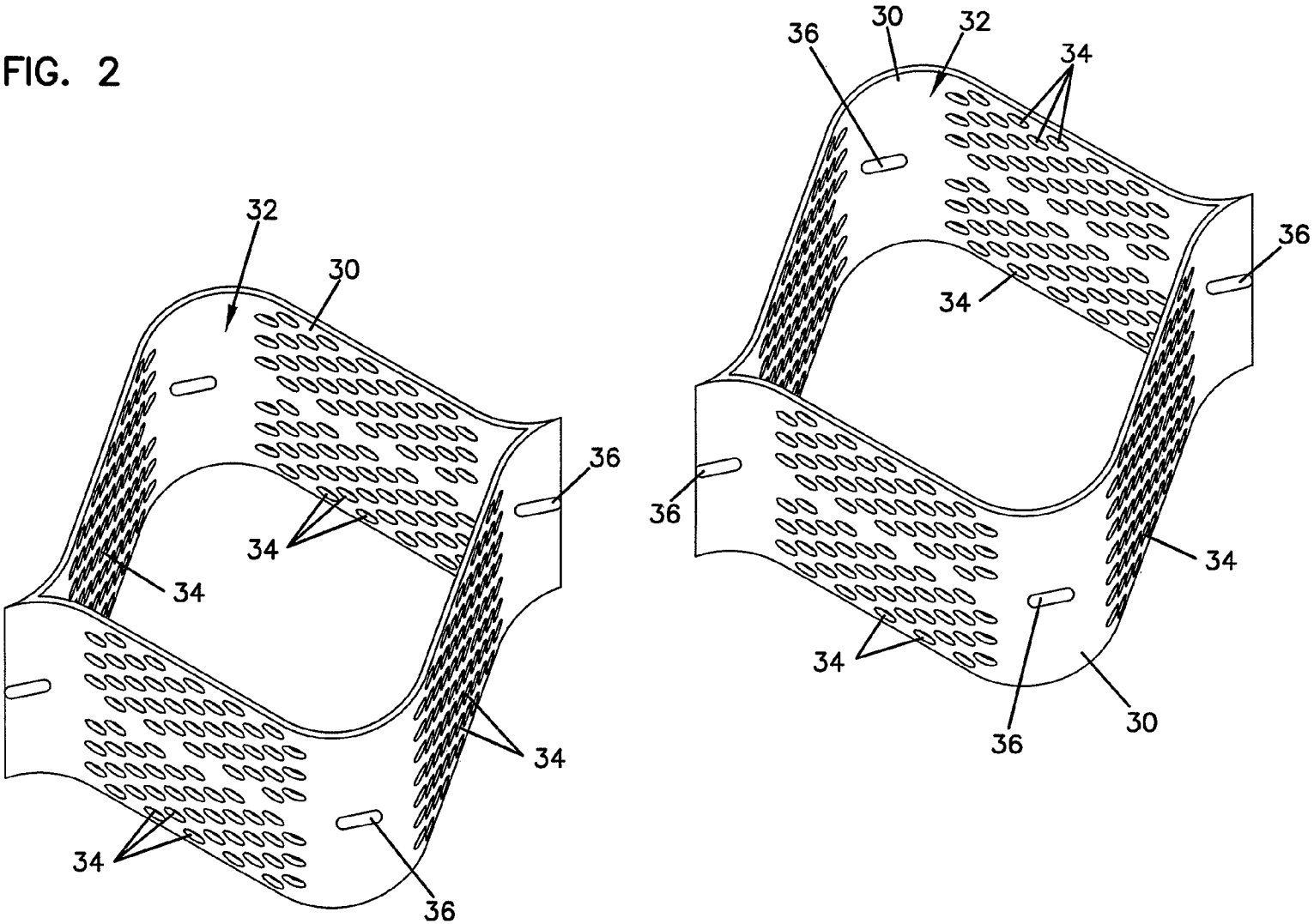
FIG. 2 is a perspective view of two cells that are part of an expanded cellular confinement structure prior to being connected together.

FIG. 2 shows two cells 32. The cells 32 in FIG. 2 differ somewhat from the depiction in FIG. 1, in that the strips 26 do not contain all of the apertures 34 as depicted in FIG. 1. The apertures 34 can be used optionally, depending upon the implementation. The option depicted in FIG. 2 does not show apertures 34 in the strips 26. FIG. 2 does depict, however, open slots 36 defined by the cell walls 30 in the strips 26. The slots 36 are utilized to cooperate with connection device 24 in order to fasten together adjacent webs 20, 22.

Figure 3:
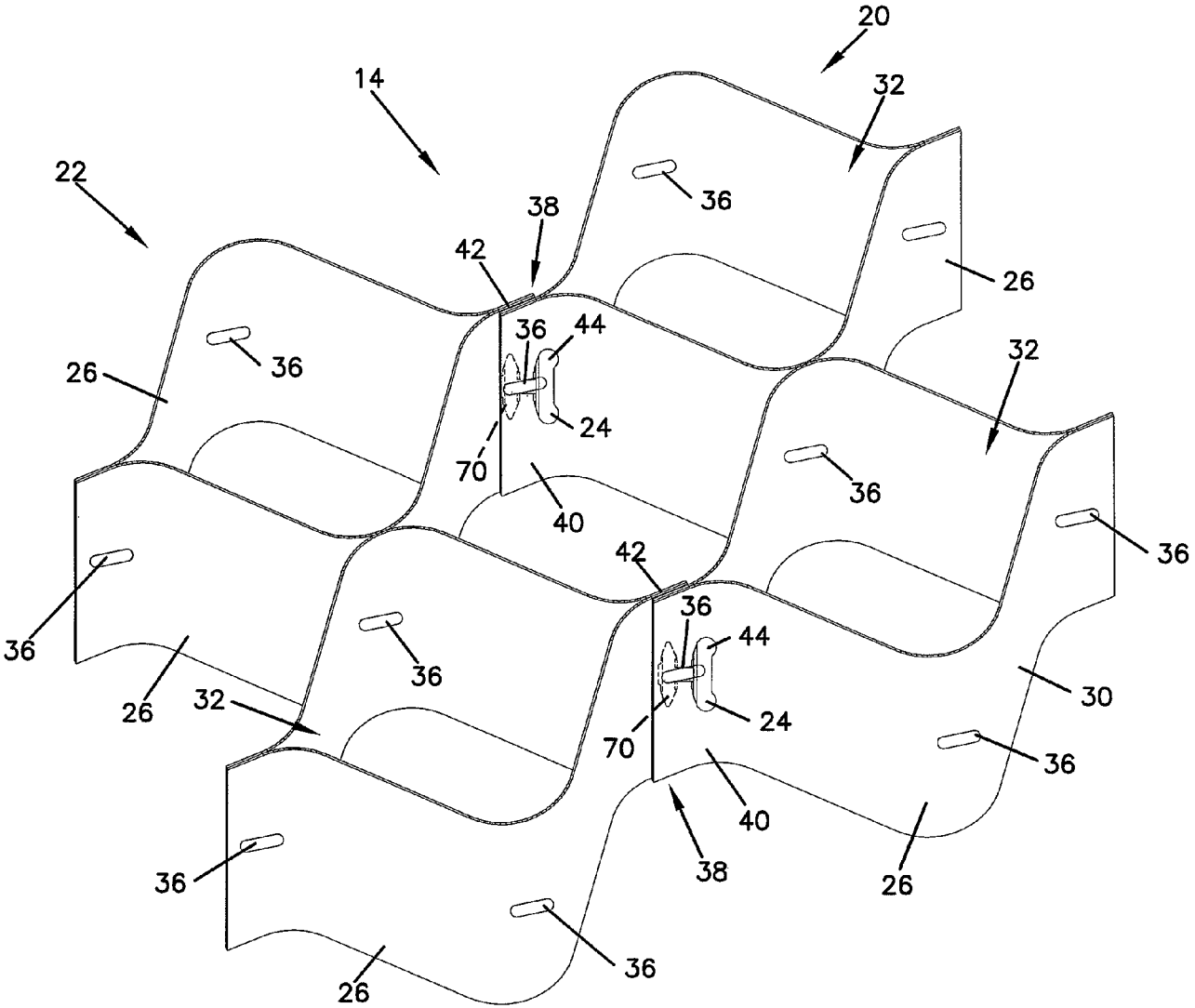
FIG. 3 is a perspective view of two expanded cellular confinement structures connected together utilizing connection devices constructed in accordance with principles of this disclosure.

FIG. 3 shows the cellular confinement system 14 with the first web 20 and the second web 22 fastened together by connection device 24. In the embodiment of FIG. 3, at least one connection device 24 is used, and as shown, a plurality of connection devices 24 is used. FIG. 3 shows specifically two connection devices 24.

Still in reference to FIG. 3, a cell overlap region 38 is depicted. In particular, there are two cell overlap regions 38 depicted. The cell overlap region, as shown, includes an open slot 36 of the first unitary web of cells 20 aligned with open slot 36 of the second unitary web of cells 22. The cell overlap region 38 defines a first side 40 and an opposite second side 42. The connection device 24 can be seen penetrating or passing through the overlap region 38 with part of the connection device 24 on the first side of the overlap region 38, while another portion of the connection device 24 can be seen in phantom on the second side 42 of the overlap region 38. An example of this will be described further below.

Attention is directed to FIGS. 4-8. FIGS. 4-8 depict one example embodiment of connection device 24. In the embodiment depicted, the connection device 24 includes an insertion member 44. The insertion member 44 has first and second opposite insertion ends 46, 47 and an insertion member extension 48 between the first insertion member end 46 and second insertion member end 47. A first length is defined by the distance between the first insertion member end 46 and second insertion member end 47.

In one embodiment, the first insertion member end 46 is tapered, by having a generally rounded triangular shape 50. This shape is required to provide a convenient and expedited use of the connection device 24 allowing for maximum width of the insertion member and therefore maximum load distribution of the forces upon the insertion member once placed in use.

Figure 4:
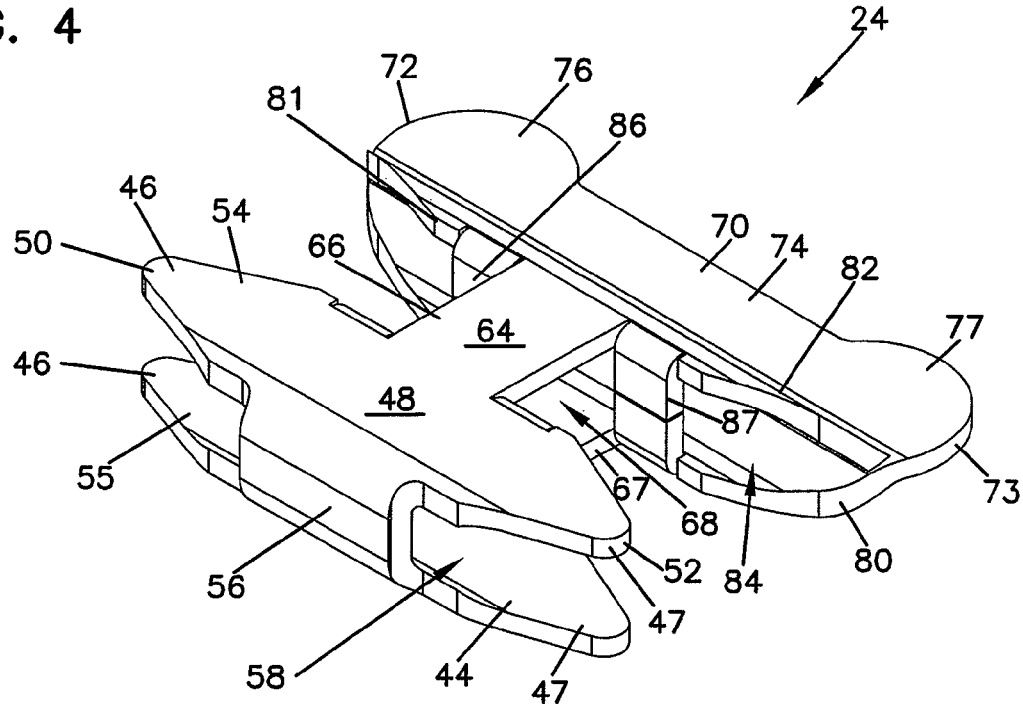
FIG. 4 is a perspective view of one embodiment of a connection device, constructed in accordance to principles of this disclosure.
Figure 5:
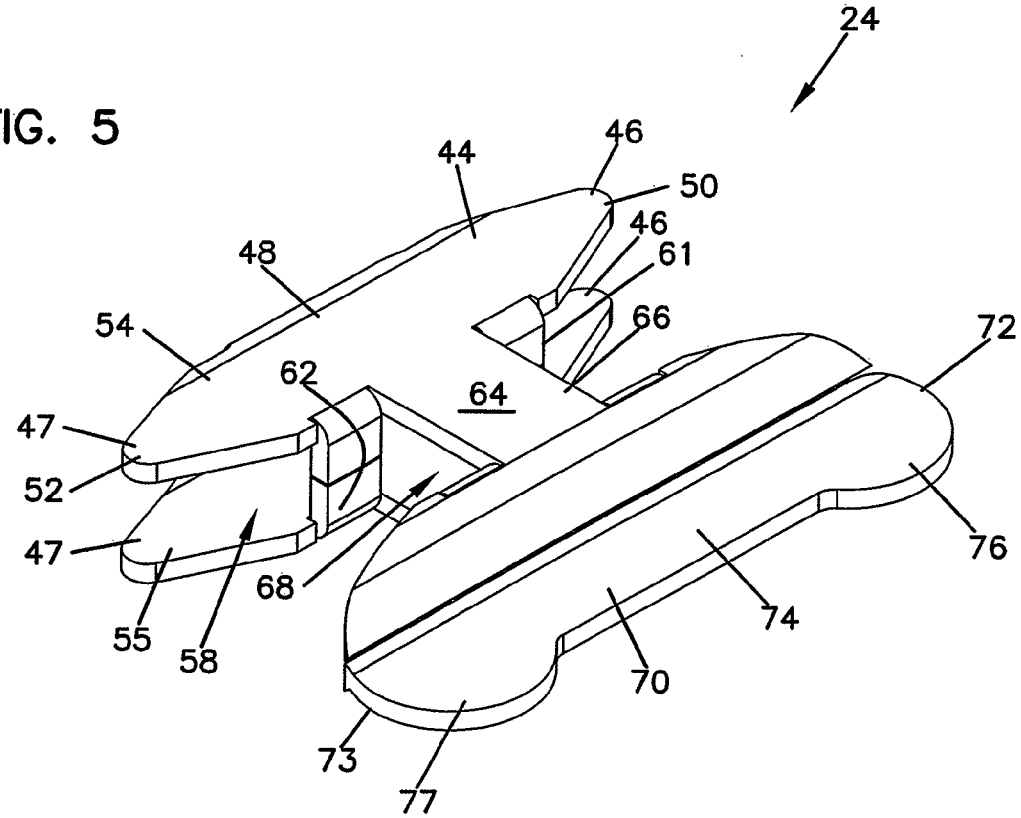
FIG. 5 is another perspective view of the connection device of FIG. 4.
Figure 6:
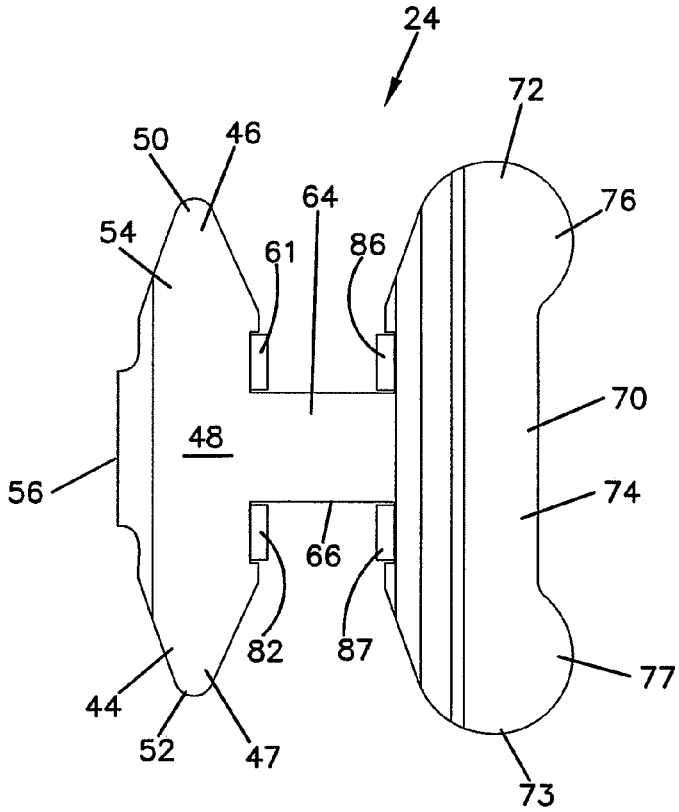
FIG. 6 is a top plan view of the connection device of FIGS. 4 and 5.
Figure 7:
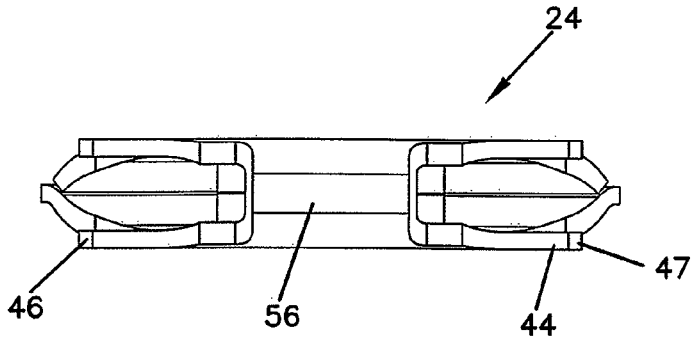
FIG. 7 is an end view of the connection device of FIG. 6.
Figure 8:
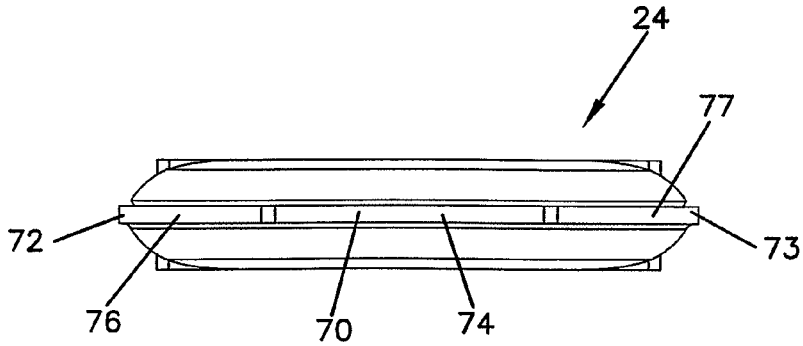
FIG. 8 is another end view of the connection device of FIG. 6, depicting the opposite end of that shown in FIG. 7.
Figure 9:
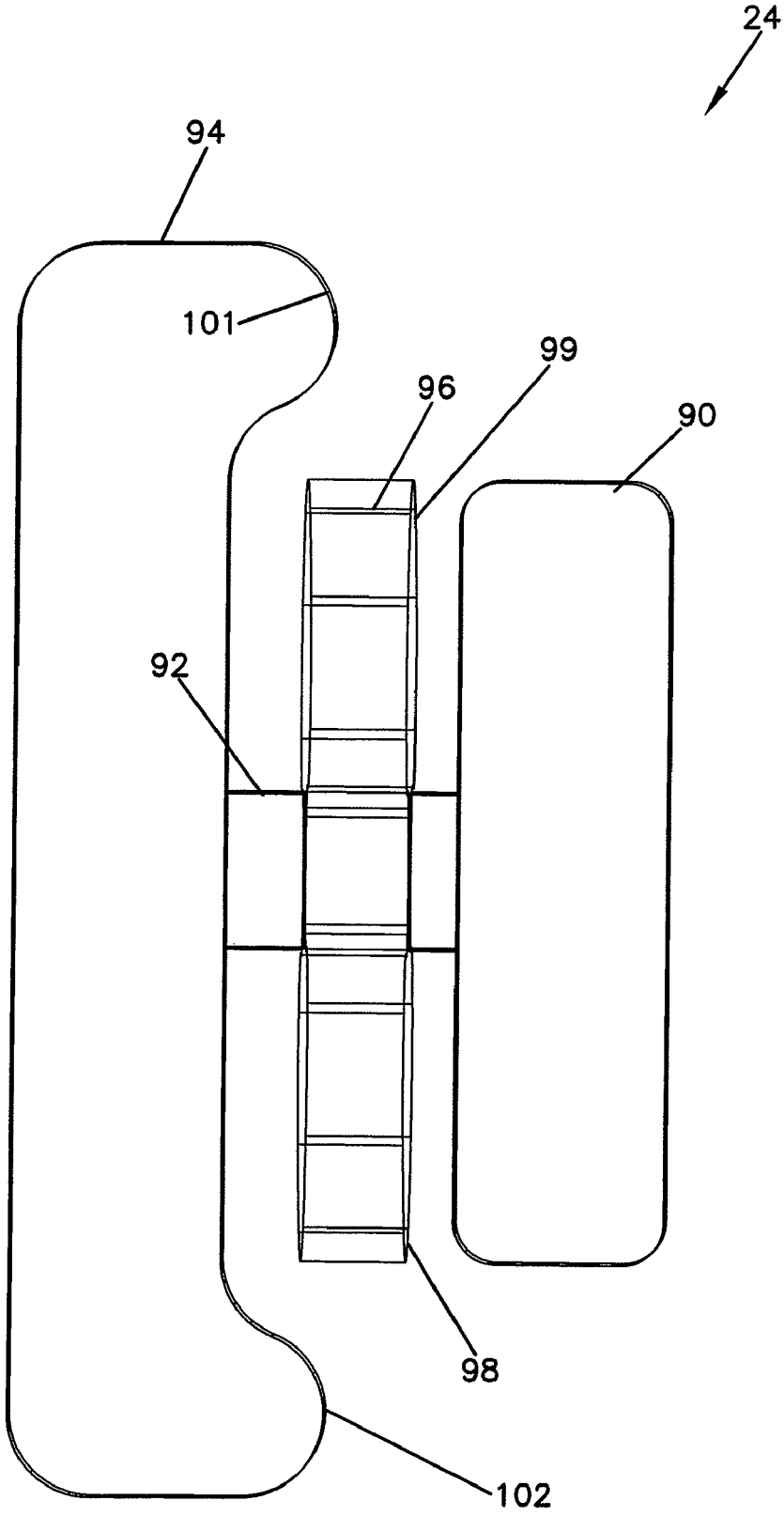
FIG. 9 is a top plan view of a second embodiment of connection device constructed in accordance with principles of this disclosure.
Figure 10:
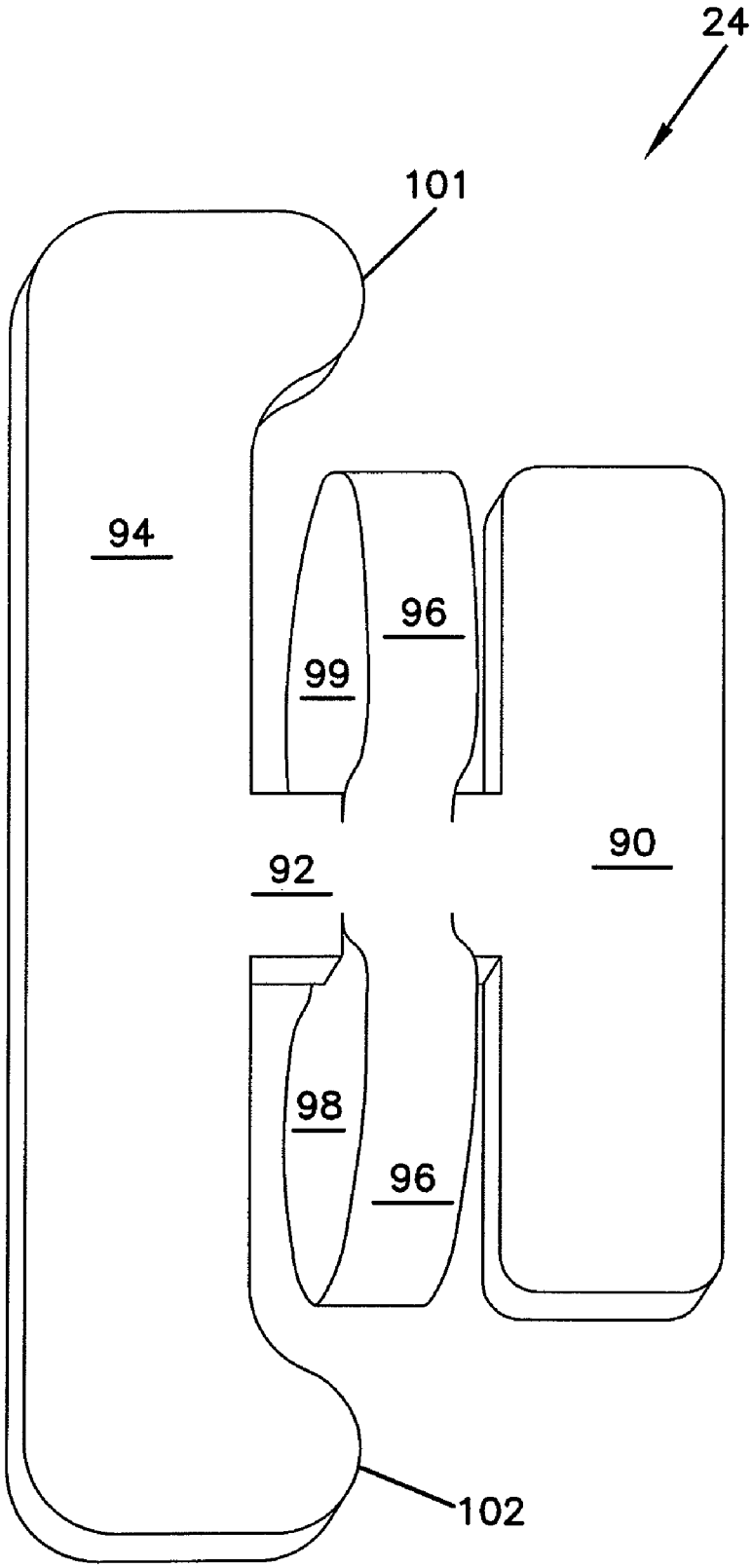
FIG. 10 is a perspective view of the connection device of FIG. 9.

In this embodiment, the second insertion end 47 is depicted as having a tapered end. As can be seen in FIG. 4, in this embodiment, the second insertion end 47 has a rounded triangular shape 52. This shape can help provide a fast and convenient use of the connection device 24 when connecting together and first and second webs 20, 22.

In the example embodiment shown, the insertion member 44 includes a pair of insertion member plates 54, 55. In the example shown, the insertion member plates 54, 55 are parallel to each other. In the example shown, the plates 54, 55 are joined by a bight section 56. In the example shown, the insertion member plates 54, 55 are spaced apart from each other and define a volume 58 therebetween. In one embodiment, the insertion member 44 has a size selected to cooperate with the size of the slot 36. Useable lengths for the insertion member 44 is less than 70 mm, for example, 20-60 mm, and in particular, 35-50 mm. The width of the insertion member 44 from an exterior of the insertion member plate 54 to the exterior of the insertion member plate 55 is also selected to cooperate with the dimension of the slots 36. In this embodiment, the width will be less than 20 mm, for example, 4-12 mm.

At an end of the insertion member plates 54, 55 opposite of the bight section 56 are a pair of bridges 61, 62 that blocks access to the volume 58 from the region above the insertion member 44. For example, if the connection device 24 is accommodating a tendon in a portion of the connection device above the insertion member 44, the bridges 61, 62 will prevent the tendon from sliding within the volume 58.

Still in reference to FIGS. 4-8, one example connection device 24 includes an integral shank 64 extending from the insertion member extension member 48 and being spaced from each of the first and second insertion member ends 46, 47. A variety of implementations are possible. In the embodiment depicted, the shank 64 extends generally perpendicular from the insertion member extension 48.

In one example, the shank 64 includes a pair of shank plates 66, 67. In the embodiment shown, the shank plates 66, 67 are parallel to each other and spaced apart to define an open volume 68 therebetween.

The shank 64 has a length that is defined as being between the insertion member 44 and a handle member 70, described below. The length of the shank 64 is less than the length of the insertion member 44, in one example.

In the embodiment shown, the connection device 24 includes handle member 70. Preferably, the handle member 70 is integral with the shank 64. The handle member 70 extends from the shank 64 at an end of the shank 64 remote from the insertion member 44.

In the example depicted, the handle member 70 has first and second handle ends 72, 73. Between the first handle end 72 and the second end 73 is a handle member extension 74.

In the embodiment shown, the shank 64 is spaced from each of the first and second handle ends 72, 73.

The handle member 70 has a length defined between the first handle end 72 and the second handle end 73. While many designs are contemplated, in the particular embodiment illustrated, the length of the handle member 70 is greater than the length of the insertion member 44. In one example, the length of the shank 64 is less than half of the length of the handle member 70 and insertion member 44. These relative dimensions cooperate with the slot 36 and allow for quick, convenient fastening of the first and second webs 20, 22.

In example embodiments, the length of the handle member 70 is not greater than 100 mm, typically, 30-80 mm, for example, 45-55 mm.

In the embodiment shown, the length of the handle member 70 is at least 10 percent greater than the length of the insertion member 44. This relative geometry helps to ensure that the connection device 24 will stay in place within the slot 36 and not work its way out.

In the embodiment shown, the handle member extension 74 includes first and second ears 76, 77 projecting therefrom. The ears 76, 77 are projecting away from the insertion member 44. In the embodiment shown, the first and second ears 76, 77 are rounded and are even with the first and second handle ends 72, 73.

Still in reference to FIGS. 4-8, the handle member 70 further includes a base plate 80 and angled handle plate 81 extending from the base plate 80. The angled handle plate 81 joins the base plate 80 at an intersection 82. From the intersection 82, the angled handle plate 81 extends at an angle from the base plate 82 until reaching the shank plate 66 of the shank 64. The angled handle plate 81 and the base plate 80 define a volume 84 therebetween. A pair of handle bridges 86, 87 extend between the angled handle plate 81 and base plate 80 at a portion of the handle member extension 74 that is opposite of the ears 76, 77. The bridges 86, 87 can help prevent a tendon that is accommodated within the volume 68 of the shank plates 66, 67 from passing into the volume 84 of the handle member 70.

Turning again to FIG. 3, it can be seen that in use, the connection device 24 will have the insertion member 44 on one side 40 of the overlap region and the handle member 70 on second side 42 of the overlap region 38. The shank 64 extends through the overlap region 38. Methods of using the connection device 24 are described further below. The connection device 24 can also be made from a single, solid piece of material, such as being cast in solid plastic.

A second embodiment of connection device 24 is depicted in FIGS. 9-12. The connection device 24 depicted in FIGS. 9-12 includes an insertion member 90, a shank 92, and a handle member 94. In this embodiment of connection device 24, there is further included a bearing member 96. The bearing member 96 extends from the shank 92 and is spaced from each of the insertion member 90 and handle member 94.

Figure 11:
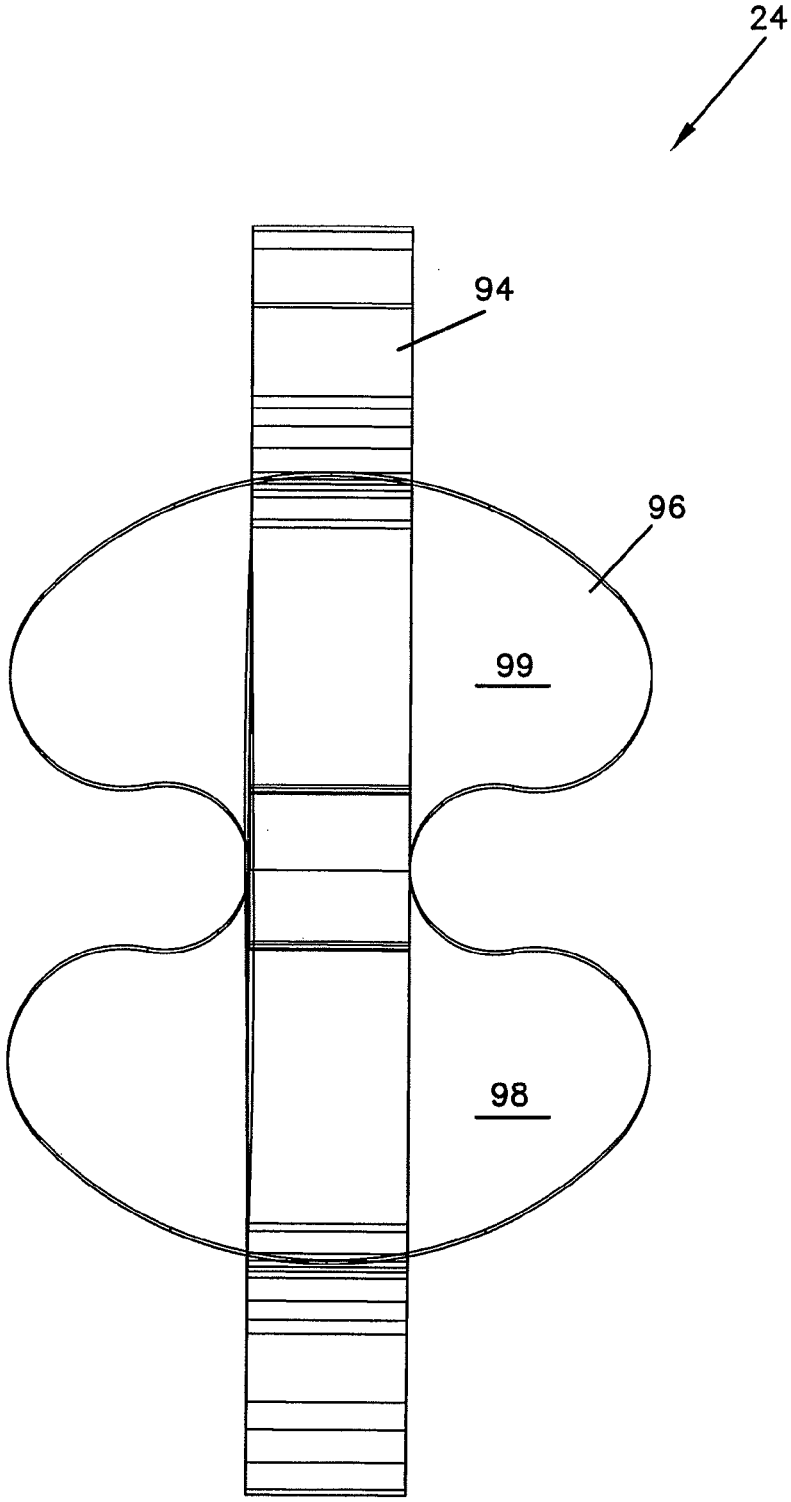
FIG. 11 is a top plan view of the connection device of FIG. 9.
Figure 12:
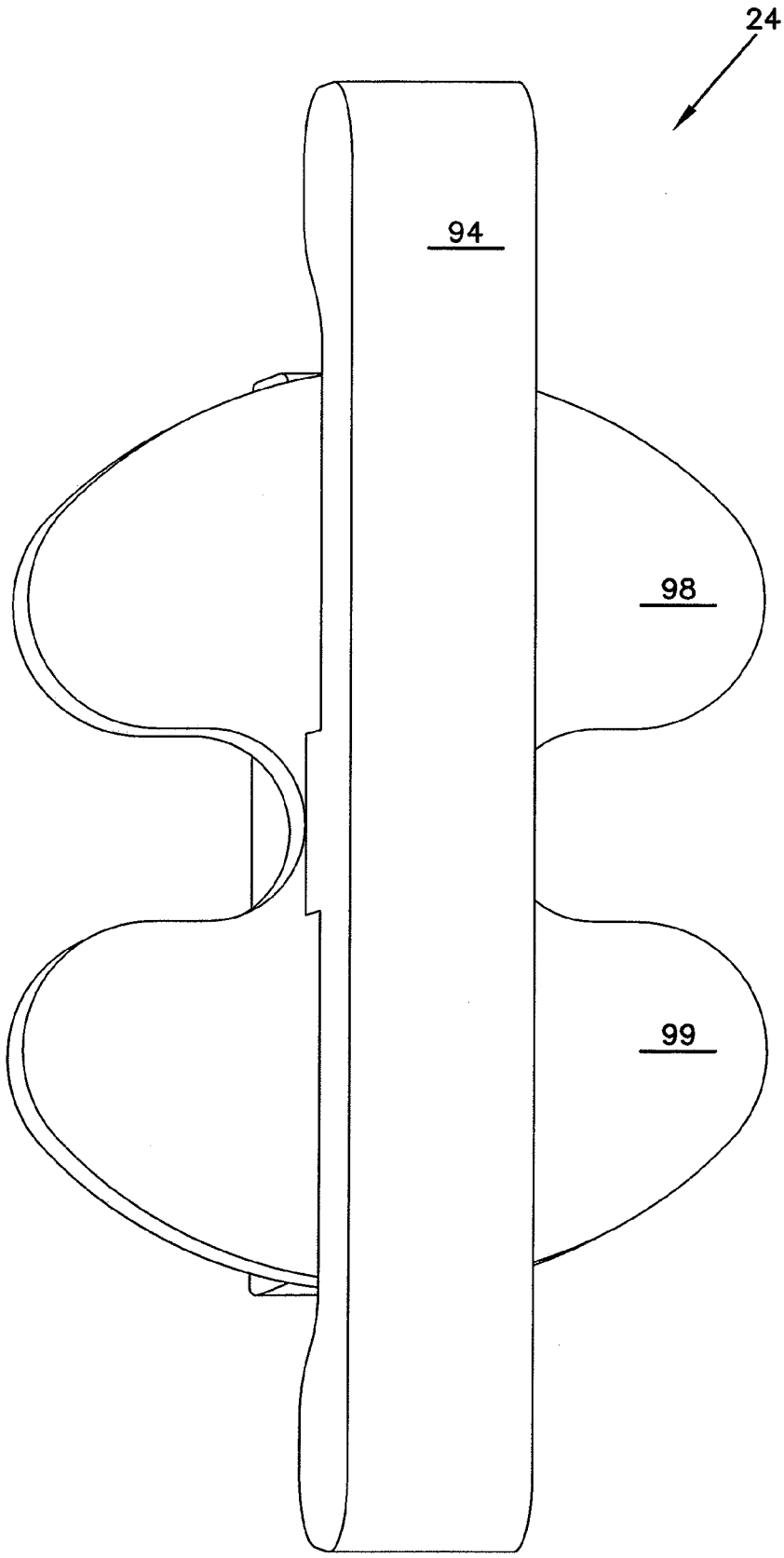
FIG. 12 is a perspective, top view of the connection device of FIGS. 9-11.

In the embodiment shown, the bearing member 96 includes a pair of arms 98, 99 extending from the shank 92. As can be seen in FIGS. 11 and 12, each of the arms 98, 99 has a width that is greater than a width of the insertion member 90 and handle member 94. The bearing member 96 is shaped for surface contact and load transfer with the strip 26. In use, the bearing member 96 will be on the same side 42 of the cell overlap region 38 as handle member 94.

In this embodiment, the handle member 94 has first and second ears 101, 102 that project toward the insertion member 90.

In use, the connection device 24 can be utilized to fasten two expanded cell confinement structures together. The method includes aligning two expanded cell confinement structures 18 so that at least one open slot 36 defined by first web 20 is aligned with at least one slot 36 defined by second web 22 to form overlap region 38.

Connection device 24 is provided. Connection device 24 is used by inserting the insertion member 44, 90 from the second side 42 of the overlap region 38 through the aligned open slots 36 of the overlap region 38. This provides the insertion member 44, 90 on the first side 40 of the overlap region 38. It provides the handle member 70, 94 on the second side 42 of the overlap region 38. It provides the shank 64, 92 to extend through the overlap region 38.

The method also includes rotating the handle member 70, 94 to rotate the connection device 24 within the overlap region 38. This helps to lock the connection device 24 within the slots 36.

In some implementations, the method can further include a step of orienting a tendon to pass through volume 68 defined by the shank 64 and through the overlap region 38.

Figure 13:
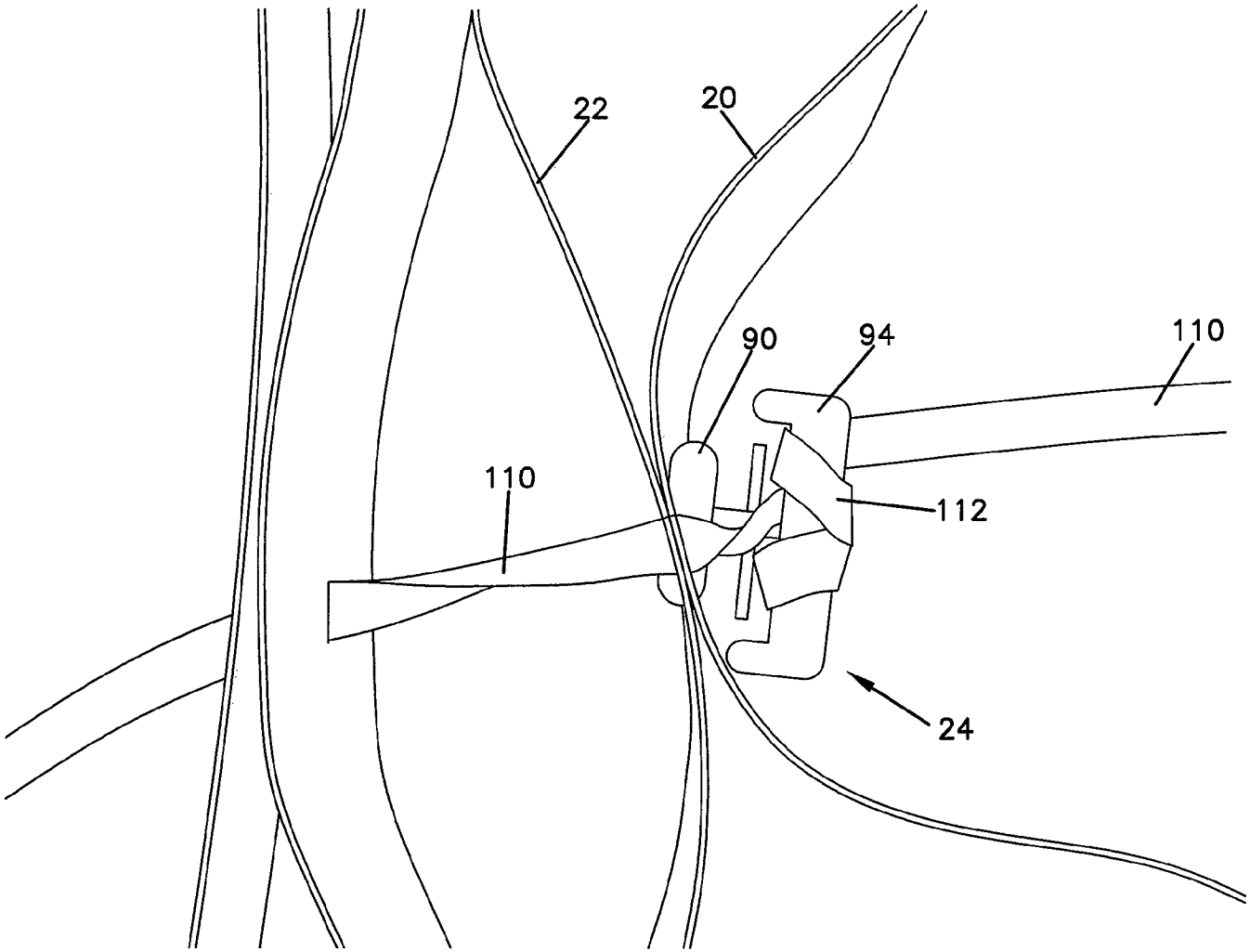
FIG. 13 is a schematic, perspective view of a step of using the connection device along with a tendon.
Figure 14:
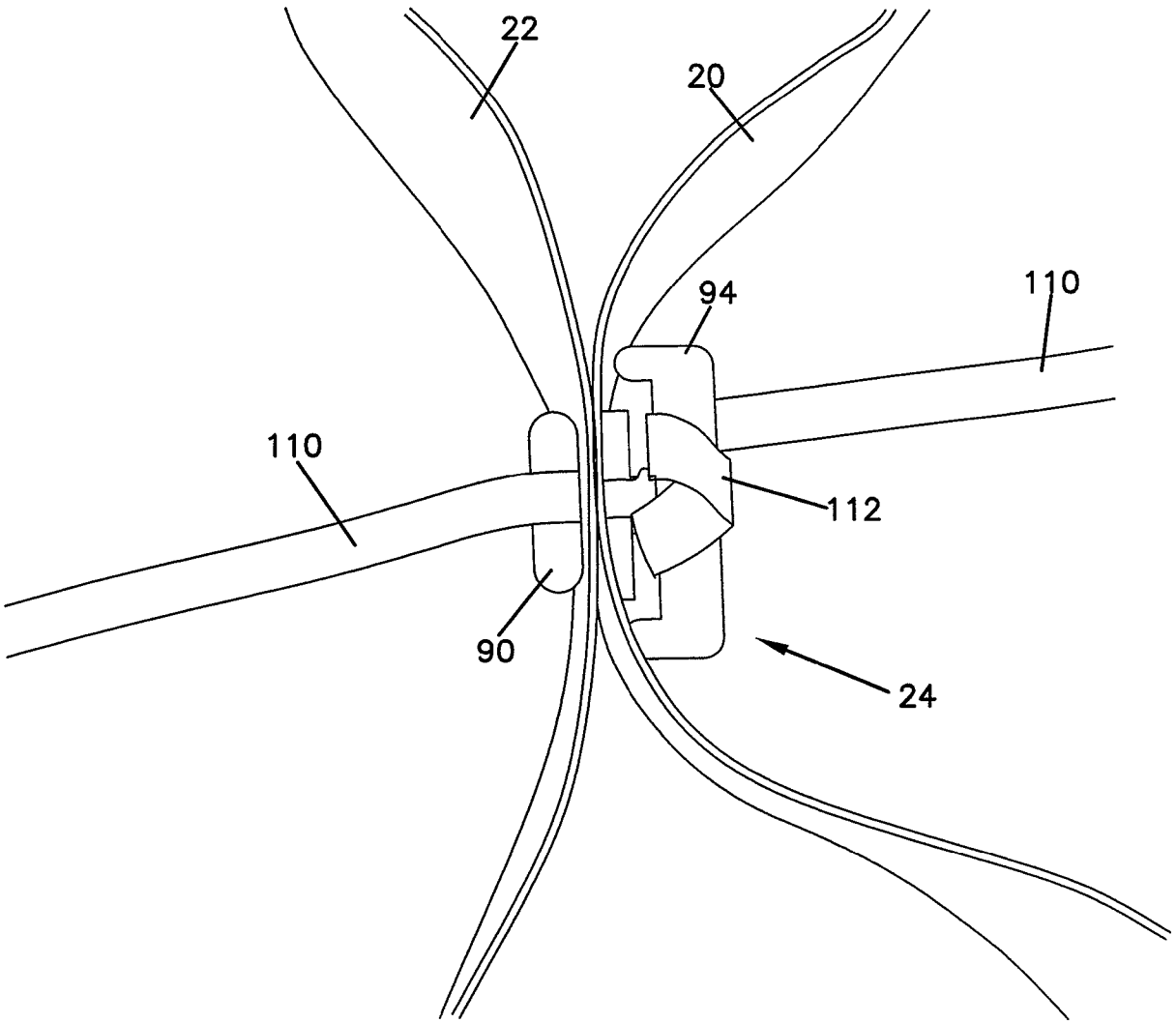
FIG. 14 is a schematic, perspective view of another step of using the connection device with a tendon.
Figure 15:
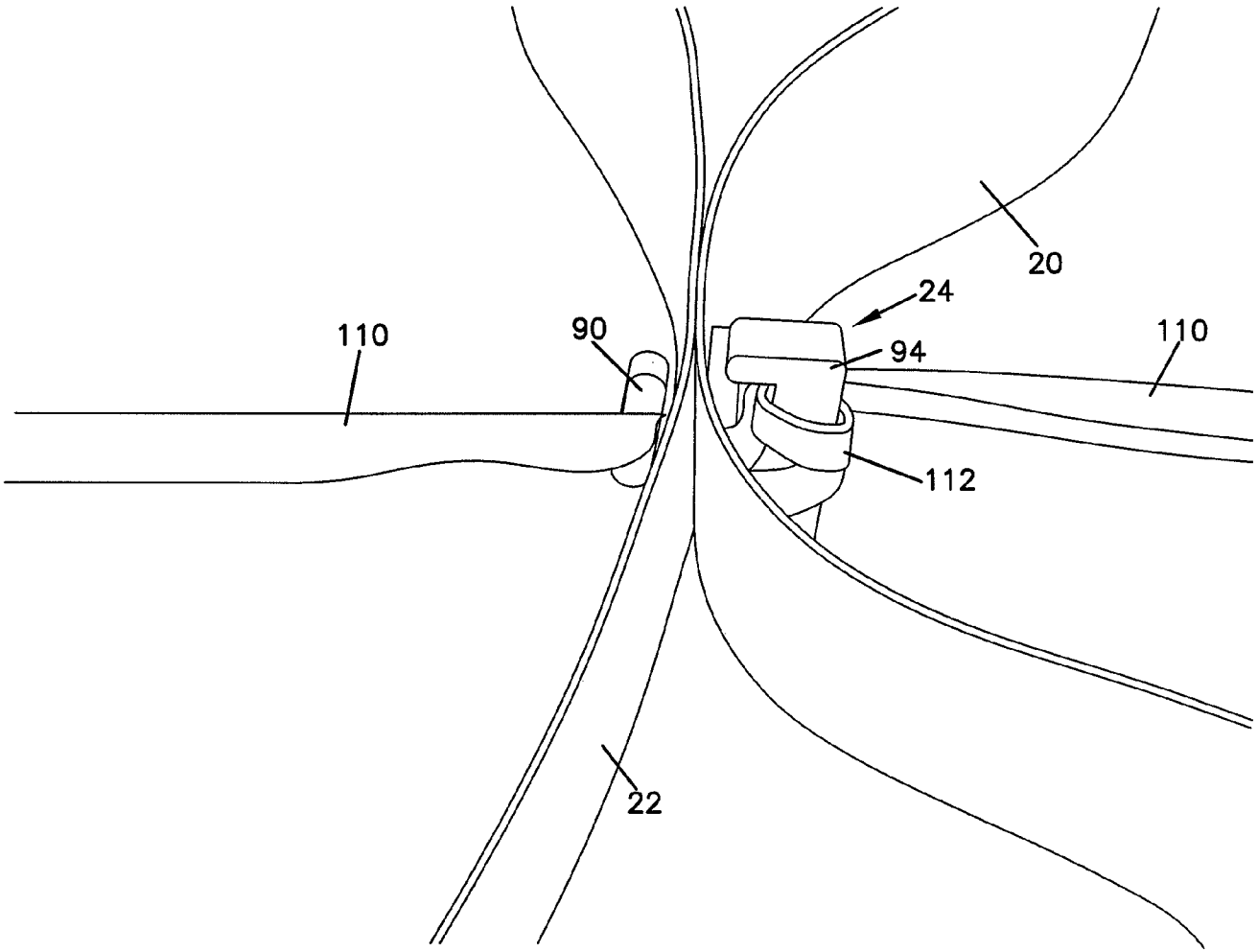
FIG. 15 is a schematic, perspective view of another step of using the connection device with a tendon.

An example of use of a tendon 110 is shown in connection with the connector device 24 of FIGS. 9-12 as shown in FIGS. 13-15. In FIG. 13, the tendon 110 is illustrated as wrapped around the handle member 94 at wrap 112. The tendon 110 is positioned under the handle member 94 and wrapped up and over one side of the handle 94. The tendon continues wrapping around the upper portion of the handle 94 to form a cross-wrap. In FIG. 13, it can be seen how the insertion member 90 is inserted or engaged into the slots 36 of two adjacent webs 20, 22, either end-to-end or edge-to-edge. The tendon 110 can also be seen extending through the slots 36 of the webs 20, 22, although the slots 36 are not visible in FIG. 13. FIG. 14 shows full engagement of the connector device 24 through the slots 36. In FIG. 14, the final step of rotating the connector device 24 to lock the connector device 24 within the slots 36 is illustrated. By comparing FIGS. 14 and 15, it can be seen that the connector device 24 is rotated about 90 degrees.

Preferably, the step of rotating includes rotating the handle member 70, 94 about 90 degrees.

In use, the slots 36 will be non-circular, for example, elliptical, or elongated-circular, or racetrack-shaped. In one embodiment, the slots 36 are shaped like two semi-circles separated by a rectangle of which one side of the rectangle is equal to the diameter of the semi-circle. When used, this shape will have a major axis and a minor axis. The aspect ratio of useable slots 36 as a ratio of the minor axis compared to the major axis is about 3:11. When compared to the dimensions of the connection device 24, the major axis of the slot 36 has a length that is 85-95%, for example, 92%, of the length of the insertion member 44, 90. The minor axis of the slot 36 will be 20-30%, for example, about 25%, of the length of the insertion member 44, 90. Further, the minor axis of the slot 36 will be about 101% of the width or thickness of the connection device 24.

The above provides a complete description. Many embodiments can be made.

We claim:

1. A connection device for fastening two expanded cellular confinement structures;

the connection device comprising:

(a) an insertion member having first and second opposite insertion ends and an insertion member extension therebetween;
(i) the insertion member having a first length between the first and second insertion ends;
(b) an integral shank extending generally perpendicular from the insertion member extension and being spaced from each of the first and second insertion ends; and
(c) an integral handle member extending generally perpendicular from the shank at an end of the shank remote from the insertion member; the handle member having first and second handle ends and a handle member extension therebetween;
(i) the shank being spaced from each of the first and second handle ends;
(ii) the handle member having a second length between the first and second handle ends;
(iii) the shank having a third length between the insertion member and the handle member;
wherein:
the second length is greater than the first length; and
the third length is less than half of the first and second lengths.

2. A connection device according to claim 1 wherein the handle member, insertion member, and shank are a solid piece.

3. A connection device according to claim 2 wherein the handle member, insertion member, and shank are a cast solid plastic.

4. A connection device according to claim 1 wherein the handle member extension includes first and second ears projecting therefrom.

5. A connection device according to claim 4 wherein the first and second ears are projecting away from the insertion member.

6. A connection device according to claim 4 wherein the first and second ears are projecting toward the insertion member.

7. A connection device according to claim 1 wherein the second length is at least 10% greater than the first length.

8. A connection device according to claim 1 further comprising a bearing member extending from the shank and spaced from each of the insertion member and handle member.

9. A connection device according to claim 8 wherein the bearing member includes a pair of arms extending from the shank; each of the arms has a width greater than a width of the insertion member and handle member.

10. A cellular confinement system comprising:
(a) a first unitary web of cells made from elongated plastic strips bonded together in spaced apart areas; the strips forming walls of the cells; at least some of the cells defining open slots;
(b) a second unitary web of cells made from elongated plastic strips bonded together in spaced apart areas; the strips forming walls of the cells; at least some of the cells defining open slots;
(i) at least one open slot of the first unitary web of cells being aligned with at least one open slot of the second unitary web of cells to result in a cell overlap region; the cell overlap region having opposite first and second sides; and
(c) at least one connection device fastening the first unitary web of cells and the second unitary web of cells together; the connection device including:
(i) an insertion member having first and second opposite insertion ends and an insertion member extension therebetween; the insertion member having a first length between the first and second insertion ends;
(A) the insertion member being located on the first side of the cell overlap region;
(ii) an integral shank extending generally perpendicular from the insertion member extension and being spaced from each of the first and second insertion ends;
(A) the shank extending through the cell overlap region by extending through both of the aligned one open slot of the first unitary web of cells and the one open slot of the second unitary web of cells;
(iii) an integral handle member extending generally perpendicular from the shank at an end of the shank remote from the insertion member; the handle member having first and second handle ends and a handle member extension therebetween; the shank being spaced from each of the first and second handle ends; and
(A) the handle member being located on the second side of the cell overlap region.

11. A cellular confinement system according to claim 10 wherein:
(a) the handle member has a second length between the first and second handle ends;
(b) the shank has a third length between the insertion member and the handle member;
(c) the second length is greater than the first length; and
(d) the third length is less than half of the first and second lengths.

12. A cellular confinement system according to claim 11 wherein the second length is at least 10% greater than the first length.

13. A cellular confinement system according to claim 10 further comprising a bearing member extending from the shank and spaced from each of the insertion member and handle member; the bearing member being located within a cell of the second unitary web of cells.

14. A cellular confinement system according to claim 10 wherein the at least one connection device includes a plurality of connection devices, each connection device fastening the first unitary web of cells and the second unitary web of cells together.

15. A cellular confinement system according to claim 10 wherein the connection device is positioned within the overlap region in a rotated position relative to an insertion position to lock the connection device within the overlap region.

16. A method of fastening two expanded cellular confinement structures together; the method comprising:
(a) aligning two expanded cell confinement structures so that at least one open slot defined by a first unitary web of cells is aligned with at least one open slot defined by a second unitary web of cells to form an overlap region having opposite first and second sides;
(b) inserting an insertion member of a connection device from the second side of the overlap region through the aligned open slots of the overlap region to provide:
(i) the insertion member on the first side of the overlap region;
(ii) a handle member of the connection device on the second side of the overlap region; and
(iii) a shank between the insert member and the handle member extending through the overlap region; and
(c) rotating the handle member to rotate the connection device within the overlap region.

17. A method of fastening according to claim 16 further including orienting a tendon to wrap around the handle member and extend through the aligned open slots of the overlap region.

18. A method of fastening according to claim 16 wherein the step of inserting an insertion member of a connection device includes using a connection device having:

(a) the insertion member having first and second opposite insertion ends and an insertion member extension therebetween;
  (i) the insertion member having a first length between the first and second insertion ends;
(b) the shank extending generally perpendicular from the insertion member extension and being spaced from each of the first and second insertion ends; and
(c) the handle member extending generally perpendicular from the shank at an end of the shank remote from the insertion member; the handle member having first and second handle ends and a handle member extension therebetween;
  (i) the shank being spaced from each of the first and second handle ends;
  (ii) the handle member having a second length between the first and second handle ends;
  (iii) the shank having a third length between the insertion member and the handle member;

wherein:

the second length is greater than the first length; and
the third length is less than half of the first and second lengths.

19. A method of fastening according to claim 16 wherein the step of rotating includes rotating the handle member approximately 90°.

20. A connection device for fastening two expanded cellular confinement structures;

the connection device comprising:

(a) an insertion member having first and second opposite insertion ends and an insertion member extension therebetween;
  (i) the insertion member having a first length between the first and second insertion ends;
(b) an integral shank extending generally perpendicular from the insertion member extension and being spaced from each of the first and second insertion ends;
  (i) the shank including a pair of shank plates, parallel to each other and spaced apart from each other to define an open volume therebetween;
(c) an integral handle member extending generally perpendicular from the shank at an end of the shank remote from the insertion member; the handle member having first and second handle ends and a handle member extension therebetween;
  (i) the shank being spaced from each of the first and second handle ends;
  (ii) the handle member having a second length between the first and second handle ends;
  (iii) the shank having a third length between the insertion member and the handle member;

wherein:

the second length is greater than the first length; and
the third length is less than half of the first and second lengths.

21. A connection device for fastening two expanded cellular confinement structures;

the connection device comprising:

(a) an insertion member having first and second opposite insertion ends and an insertion member extension therebetween;
  (i) the insertion member having a first length between the first and second insertion ends;
  (ii) the insertion member including a pair of insertion member plates, parallel to each other and joined by a bight section; the insertion member plates being spaced apart from each other;
(b) an integral shank extending generally perpendicular from the insertion member extension and being spaced from each of the first and second insertion ends; and
(c) an integral handle member extending generally perpendicular from the shank at an end of the shank remote from the insertion member; the handle member having first and second handle ends and a handle member extension therebetween;
  (i) the shank being spaced from each of the first and second handle ends;
  (ii) the handle member having a second length between the first and second handle ends;
  (iii) the shank having a third length between the insertion member and the handle member;

wherein:

the second length is greater than the first length; and
the third length is less than half of the first and second lengths.

22. A cellular confinement system comprising:

(a) a first unitary web of cells made from elongated plastic strips bonded together in spaced apart areas; the strips forming walls of the cells; at least some of the cells defining open slots;
(b) a second unitary web of cells made from elongated plastic strips bonded together in spaced apart areas; the strips forming walls of the cells; at least some of the cells defining open slots;
  (i) at least one open slot of the first unitary web of cells being aligned with at least one open slot of the second unitary web of cells to result in a cell overlap region; the cell overlap region having opposite first and second sides; and
(c) at least one connection device fastening the first unitary web of cells and the second unitary web of cells together; the connection device including:
  (i) an insertion member having first and second opposite insertion ends and an insertion member extension therebetween; the insertion member having a first length between the first and second insertion ends;
    (A) the insertion member being located on the first side of the cell overlap region;
  (ii) an integral shank extending generally perpendicular from the insertion member extension and being spaced from each of the first and second insertion ends;
    (A) the shank extending through the cell overlap region by extending through both of the aligned one open slot of the first unitary web of cells and the one open slot of the second unitary web of cells;
    (B) the shank including a pair of shank plates, parallel to each other and spaced apart from each other to define an open volume therebetween and to accommodate the bearing of the load of the cells upon the shank plates when placed into service under load;
  (iii) an integral handle member extending generally perpendicular from the shank at an end of the shank remote from the insertion member; the handle member having first and second handle ends and a handle member extension therebetween; the shank being spaced from each of the first and second handle ends; and (A) the handle member being located the second side of the cell overlap region.

23. A cellular confinement system according to claim 22 further including a tendon extending through the open volume in the shank and through the aligned one open slot of the first unitary web of cells and the one open slot of the second unitary web of cells.

24. A method of fastening two expanded cellular confinement structures together; the method comprising:

(a) aligning two expanded cell confinement structures so that at least one open slot defined by a first unitary web of cells is aligned with at least one open slot defined by a second unitary web of cells to form an overlap region having opposite first and second sides;

(b) inserting an insertion member of a connection device from the second side of the overlap region through the aligned open slots of the overlap region to provide:

(i) the insertion member on the first side of the overlap region;

(ii) a handle member of the connection device on the second side of the overlap region; and (iii) a shank between the insert member and the handle member extending through the overlap region;

(c) rotating the handle member to rotate the connection device within the overlap region; and (d) orienting a tendon to pass through a volume defined by the shank and through the overlap region.

25. A method according to claim 24 wherein the step of inserting an insertion member of a connection device includes inserting a connection device wherein the handle member, insertion member, and shank are a cast solid plastic.

* * * * *